US006320553B1

(12) United States Patent
Ergene

(10) Patent No.: US 6,320,553 B1
(45) Date of Patent: Nov. 20, 2001

(54) MULTIPLE FREQUENCY REFLECTOR ANTENNA WITH MULTIPLE FEEDS

(75) Inventor: Ahmet D. Ergene, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/461,176

(22) Filed: Dec. 14, 1999

(51) Int. Cl.[7] ..... H01Q 13/00
(52) U.S. Cl. ..... 343/781; 343/761
(58) Field of Search ..... 343/781 P, 781 CA, 343/781 R, 779, 761, 725, 755, 778, 909, 753, 839, 840

(56) References Cited

U.S. PATENT DOCUMENTS 3,438,041 * 4/1969 Holtum, Jr. ..... 343/779
3,710,341 * 1/1973 Sciambi, Jr. ..... 343/779
3,866,233 * 2/1975 Schmidt ..... 343/761
3,927,408 * 12/1975 Schmidt ..... 343/779
4,259,674 * 3/1981 Dragone et al. ..... 343/909
4,439,773 * 3/1984 Chu ..... 343/778
5,041,840 * 8/1991 Cpolla et al. ..... 343/725
5,321,413 * 6/1994 Lenormand ..... 343/755
5,576,721 * 11/1996 Hwang et al. ..... 343/753

* cited by examiner

*Primary Examiner*—Don Wong
*Assistant Examiner*—Chuc Tran D
(74) *Attorney, Agent, or Firm*—Carter, Ledyard & Milburn

(57) ABSTRACT

A reflector antenna system with multiple feeds each operating in a separate frequency band. The antenna system includes a main parabolic reflector and an ellipsoidal subreflector configured in a Gregorian arrangement. Mutual blockage between the multiple feeds is reduced by their orientation and arrangement. The system includes a transversely positioned feed and an axial feed located in the focal region of the main reflector. The transverse feed may be integral with the subreflector. The system also includes a third feed placed at the virtual focal point of the subreflector.

47 Claims, 4 Drawing Sheets

MULTIPLE FREQUENCY REFLECTOR ANTENNA WITH MULTIPLE FEEDS

BACKGROUND OF THE INVENTION

The present invention relates generally to reflector antennas, and more specifically to reflector antennas operating in multiple frequency bands.

Antennas with paraboloidal reflectors are commonly used for satellite communications in which radio frequency signals are typically transmitted between an earth station and a satellite, or vice versa. Paraboloidal reflector antennas are also used in radar and other communications applications as well. Such antennas are typically constructed in a prime focus configuration where microwave frequency energy is coupled to a transceiver by an antenna feed mounted near a focal point of the main paraboloidal reflector. Other commonly used antenna configurations include Gregorian and Cassegrain which employ a small ellipsoidal or hyperboloidal subreflector mounted near the focal point of the main paraboloidal reflector. A Gregorian or Cassegrain antenna typically includes a feed located between the main reflector and the subreflector.

The purpose of an antenna feed is to connect a transceiver to the reflector. Antennas intended for operation over multiple frequency bands normally require a corresponding number of multiple feeds and subreflectors. As a result, antenna construction and operation may become quite complicated as a result of the differences in the wavelengths among the different frequency bands and the associated physical structure of the antenna. Antennas have typically been designed for transmissions in both the C and KU-bands. The C-band covers frequencies from about 3.6 GHz to 6.5 GHz. The KU-band covers frequencies from about 10.9 GHz to 14.5 GHz. The wavelengths between these two frequency bands can vary from about 3 inches for the C-band down to about 1 inch for the KU-band. More recently, antennas have been required to handle satellite communications in the X-band covering frequencies from about 7.2 GHz to 8.4 GHz. The wave guiding and wave handling structures of the antenna must be physically matched to the length of the electromagnetic waves being handled. The need to receive and transmit signals in the different bands from a single antenna dish system has created several problems. The different geometries required for handling electromagnetic waves in several different bands (e.g. C, KU and X-bands) has caused significant difficulties in receiving and processing both frequency bands. In addition, mutual blockage between antenna feeds typically occurs due to the use of several different feeds in the same antenna configuration.

Several different devices have been used to resolve the difficulties associated with processing multiple frequencies. For example, as described in Varley, R. F., "EHF Satcom Terminal Antennas", Session Record 3, Southcon 1982, Electronic Conventions, Inc., El Segundo, Calif., a dual reflector antenna in a Cassegrainian configuration with a dichroic subreflector has been used to reduce blockage between two different feeds. Similarly, a coaxial feed, such as disclosed in U.S. Pat. No. 5,636,944 to Weinstein et al., allows for simultaneous transmission and reception in the C-band and either the X or KU-bands. However, none of the known prior art antenna structures provide an antenna structure that successfully allows for the simultaneous transmission or reception of waves in the C, X and KU bands with significant reduction in mutual blockage.

In addition to difficulties with construction and arrangement, current multiple frequency antenna systems also suffer from aberration problems. An antenna beam may suffer from some sort of aberration if its feed is located away from the geometrical focus thereby preventing the production of a radiated planar wavefront. These aberration problems may be corrected through the use of an array feed system. However, known multiple frequency antenna systems do not include an array feed system and an aberration correction capability.

Polarization refers to the direction and behavior of the vector associated with the electric field of the electromagnetic signal which is radiating through free space (i.e. empty space with no electrons, ions or other objects to distort the radiation). In signals with linear polarization, the electric field vectors sinusoidally reverse their direction in a plane which is orthogonal to the radiation path, but they do not rotate. If the orientation of the vectors is vertical, the signal is said to have vertical polarization; if the orientation is horizontal, the signal is said to have horizontal polarization.

In contrast, if the direction of the electric filed vectors rotates at some constant angular velocity then the signal is said to have elliptical polarization. Signals with elliptical polarization can be effectively generated by combining two linearly polarized signals which are oriented in a orthogonal relationship and which have a predetermined phase difference between their electric field vectors. Circular polarization is a special case of elliptical polarization in which the two linearly polarized signals have electric field vectors of equal magnitude and a phase difference of 90 degrees. Satellite communications are typically conducted with circularly-polarized signals because of the resistance of the signal to multipath distortion, but are unable to achieve polarization purity due to cross polarization.

The cross polarized component in the antenna beam is the orthogonally polarized (e.g. vertically polarized versus horizontally polarized or right hand circularly polarized versus left hand circularly polarized) signal unintentionally present with the intended (i.e. co-polarized) component of polarization. A signal that includes the unintended component is typically referred to as lacking polarization purity. The cross polarized component has the effect of reducing the signal strength in the co-polarized component and increasing interference with signals of the orthogonal polarization. A receiver that includes polarization diversity is capable of handling two orthogonal polarizations independently and purely.

As discussed above, current multi-feed antenna systems have many shortcomings and it is an object of the present invention to obviate many of these shortcomings and to provide a novel multiple feed antenna system and method.

It is another object of the present invention to provide a novel reflector antenna and method that is capable of transmitting and receiving simultaneously in multiple frequency bands.

It is still another object of the present invention to provide a novel reflector antenna and method for minimizing mutual blockage between antenna feeds.

It is a further object of the present invention to provide a novel reflector antenna and method to provide full polarization of diverse elements to correct for cross polarizing components and achieve polarization purity.

It is yet another object of the present invention to provide a novel high efficiency reflector antenna and method with correct phase and amplitude illumination of the reflector.

It is yet a further object of the present invention to provide a novel reflector antenna and method of fully polarizing diverse elements to accommodate polarized signals of any sense and orientation.

It is still a further object of the present invention to provide a novel reflector antenna and method having a flexible design for multi-purpose applications.

It is still another object of the present invention to provide a novel reflector antenna and method utilizing fixed phase and amplitude weights to provide a low cost design for steady state operation.

It is yet another object of the present invention to provide a novel reflector antenna and method utilizing variable phase and amplitude weights for adaptive optics that address temporal changes.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
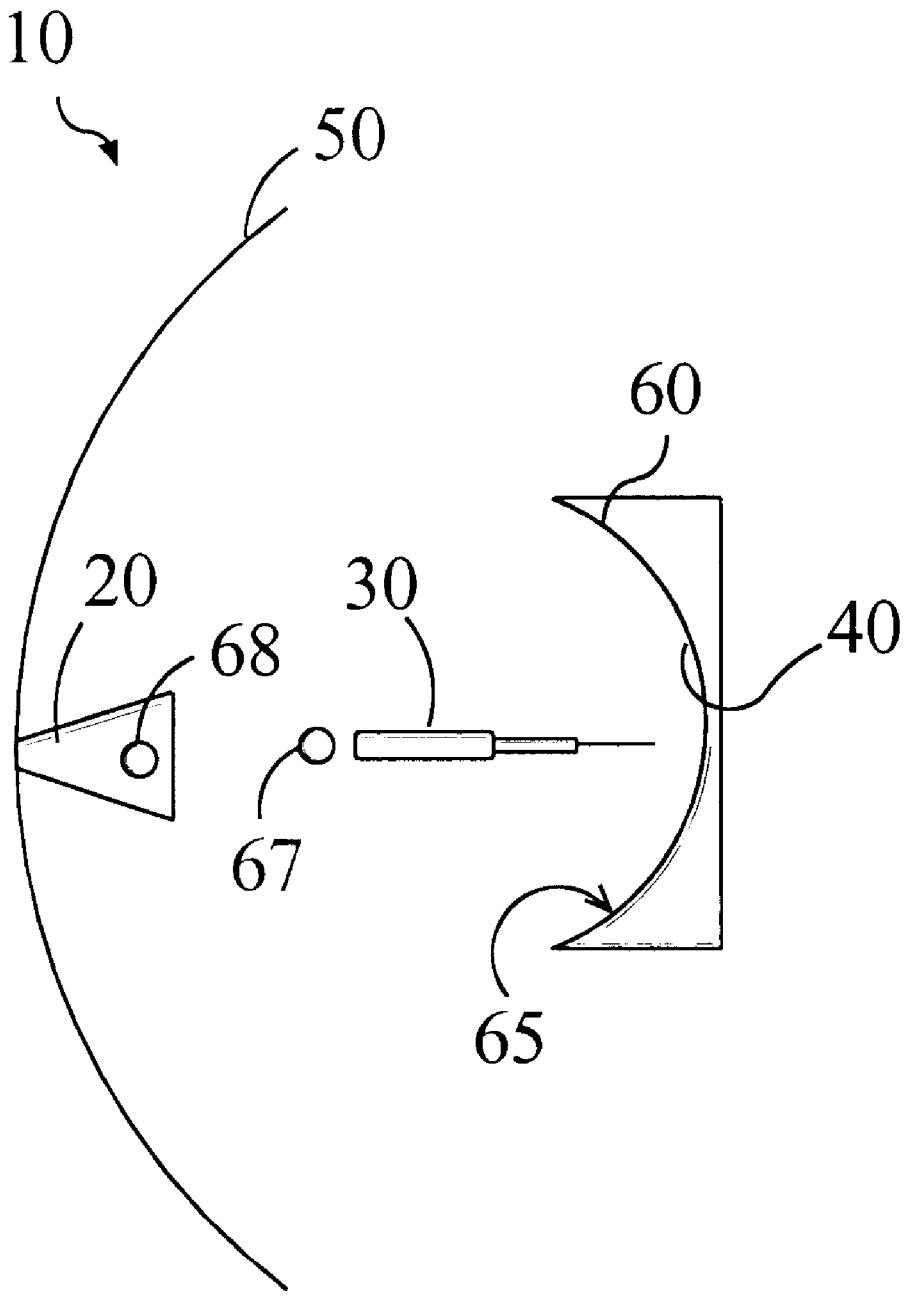
FIG. 1 is a schematic side view of a dual reflector antenna according to the present invention.

An example of a reflector antenna system 10 according to the present invention is shown in FIG. 1. The system 10 includes a main reflector 50 and a subreflector 60 arranged in a Gregorian arrangement. Preferably, the main reflector 50 is a paraboloidal reflector with a focal region. The subreflector 60 is preferably an ellipsoidal reflector in the focal region of the main reflector 50 with both a virtual focal point 68 and a real focal point 67.

The antenna includes multiple feeds with each feed operating in a separate frequency band. A mid-band feed 40, typically operating in the X-band, is located in the vicinity of the focal region of the main reflector 50. A high band feed 30, typically operating in the KU-band, is integrally located with the subreflector 60. A low band feed 20, typically operating C-Band, is located in the vicinity of the virtual focal point 68 for the subreflector 60. The high-band feed 30 is preferably a linear feed and is oriented generally orthogonal to a line tangent to the curved surface of the subreflector 60 at the center of the subreflector. The novel arrangement of the feeds reduces mutual blockage of the radiated and received energy. For example, through its orientation and relation size the high-band of the radiated and received energy. For example, through its orientation and relative size the high-band feed 30 presents a narrow profile to both the mid and low band feeds 40, 20.

Although depicted as a center fed paraboloidal reflector, primary reflector 50 may also be a conventional spherical reflector, which has well known scanning advantages over paraboloidal designs. In addition, well known specialty designs (e.g. ring focus) may be used for the center fed reflector 50. Self blockage of feeds remains a problem with center fed reflectors; however, it is within the scope of the present invention to use an offset reflector in order to mitigate self blockage problems. The subreflector 60 may be shaped for maximum illumination efficiency of the main reflector, for example, as described in the article Galindo, V., "Design of Dual-Reflector Antennas with Arbitrary Phase and Amplitude Distributions", IEEE Trans. Antennas Propagat., vol. AP-12, pp. 403–408, July 1964, incorporated by reference herein.

Figure 4:
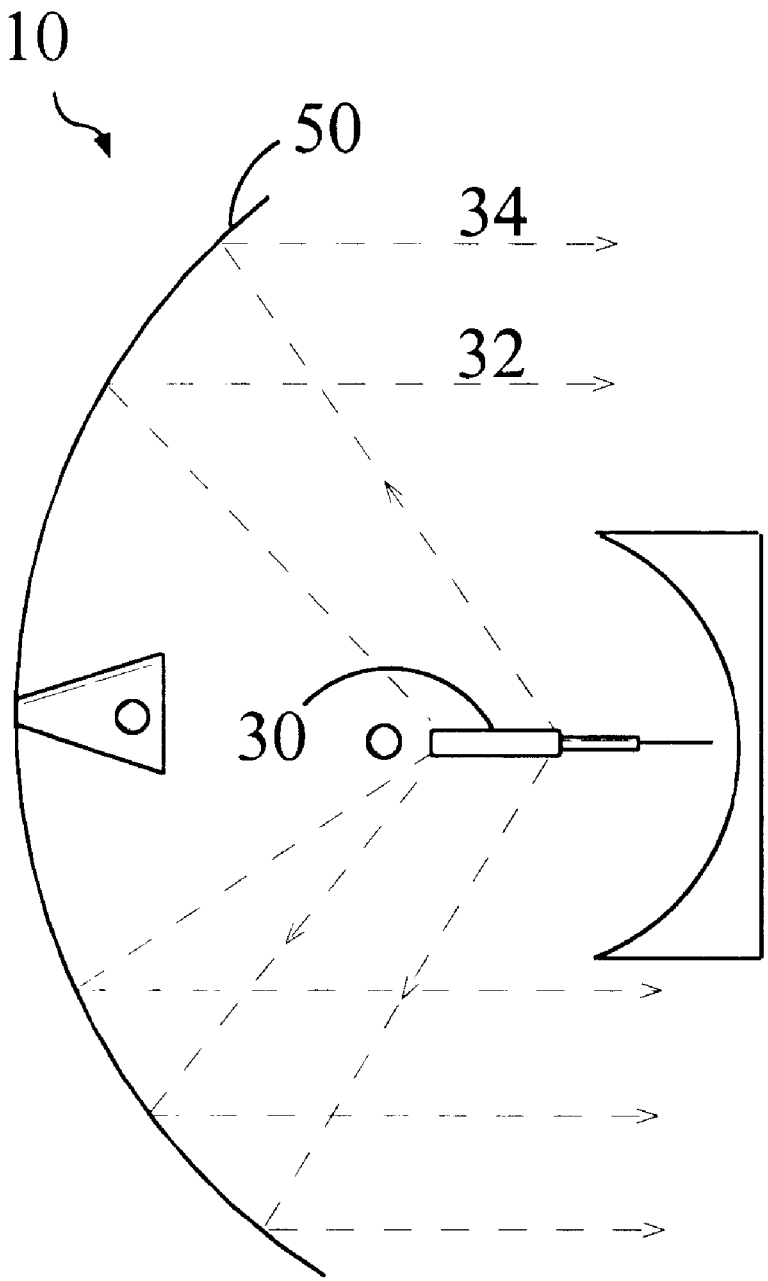
FIG. 4 is a schematic side view of the dual reflector antenna shown in FIG. 1, illustrating typical ray tracings from the high band feed.

The linear feed 30 may pass through the focal point of the paraboloidal reflector 50. As shown in FIG. 4, the high-band feed 30 receives or transmits electromagnetic signals that illuminate the main reflector 50. Linear feeds are known in the art, and may include end-fire antennas that distribute radiation from a guided slow wave structure. A dielectric polyrod or a long helix may function as an acceptable linear feed 30. In addition, the linear feed 30 may be an array of discrete elements including a linear Yagi array of crossed dipole elements or slotted waveguide array of slots cut into the wall of a waveguide.

The linear feed 30 may include a system for correcting for defocusing aberrations using conjugate field matching. Analytically determining the amplitude and phase of the fields in the focal region as a complex number allows for matching of these synthesized fields by using the complex conjugate numbers as the excitation for the elements in the linear array. In the case where a helix feed is employed, the matching of the fields will require designing a varying pitch feed. Similarly, a dielectric polyrod feed may require a varying cross-section in order to apply field matching.

Figure 2:
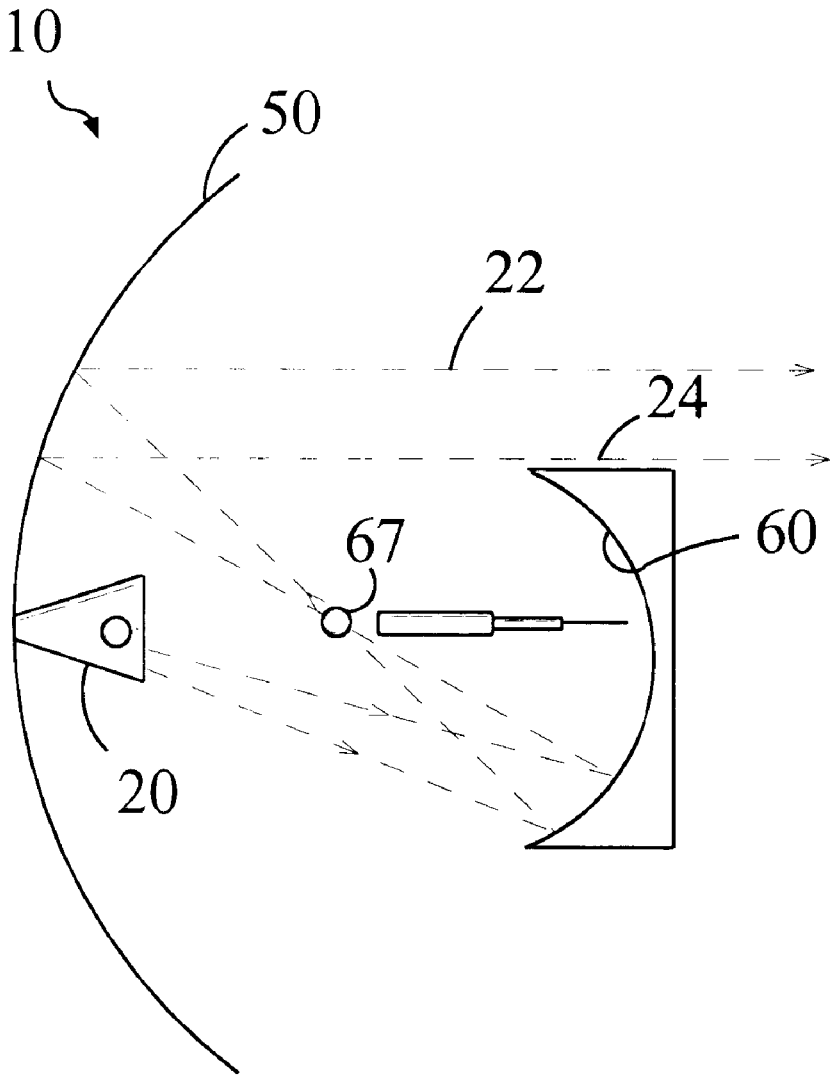
FIG. 2 is a schematic side view of a dual reflector antenna shown in FIG. 1, illustrating typical ray tracings from the low band feed.

The low-band feed 20, is preferably selected from one of several well known high performance feeds such as a corrugated horn or another hybrid-mode horn (e.g. scalar horn). As shown in FIG. 2, the low-band feed may illuminate the subreflector surface 60.

The surface 65 of the subreflector 60 is dichroic and may also be termed as a Frequency Selective Surface (FSS). The FSS 65 is tuned so that the subreflector 60 is transparent to the energy emitted and received by the mid-band feed 40, while reflecting the rays emitted and received by the low and high band feeds 20, 30. The use of a dichroic surface for the surface of the subreflector 60 facilitates the reduction in mutual blockage between the feeds.

Figure 3:
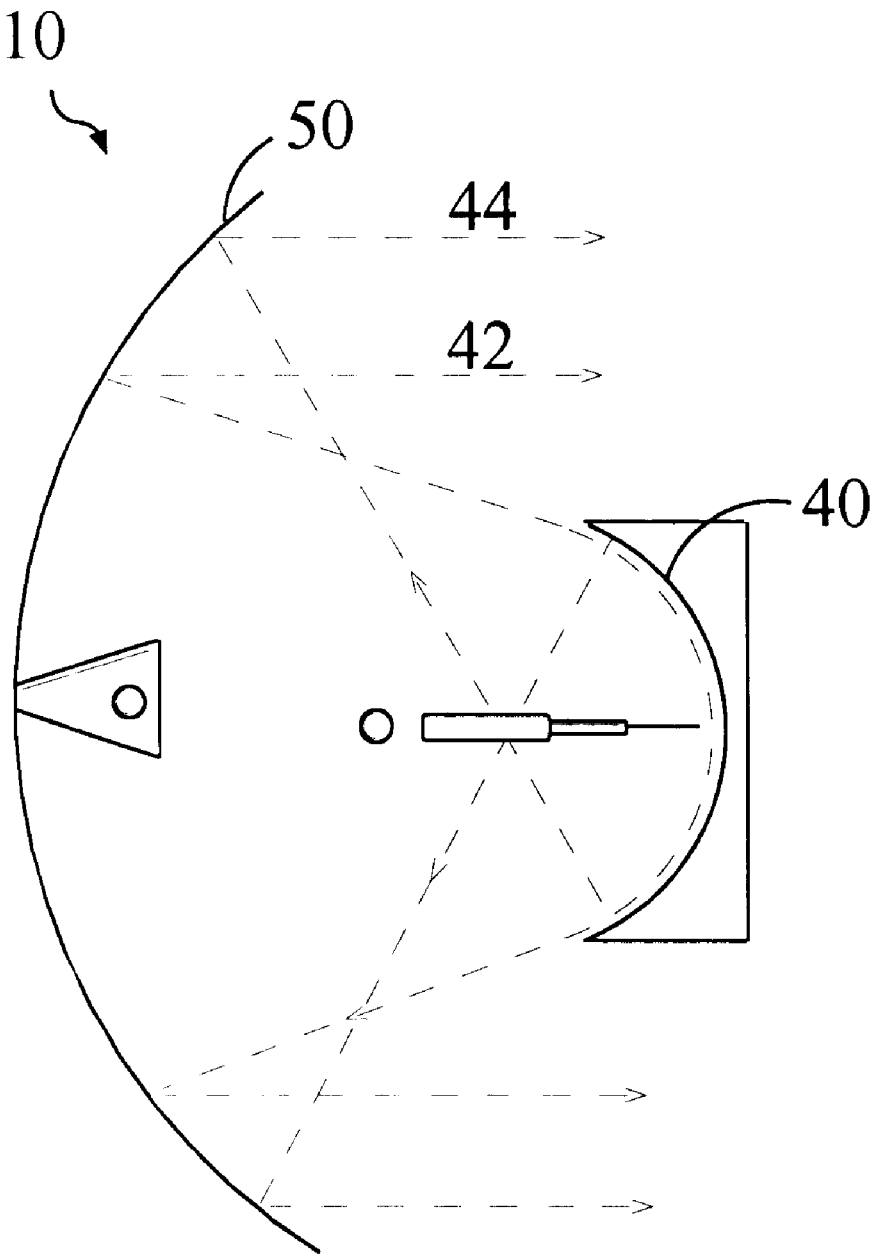
FIG. 3 is a schematic side view of the dual reflector antenna shown in FIG. 1, illustrating typical ray tracings from the mid band feed.

The transverse surface or mid-band feed 40 is preferably a phased array located at the focal region, but not containing the focal point of the primary reflector 50 (or the caustic of non-paraboloidal reflectors). As shown in FIG. 3 the surface feed 40 may transmit or receive electromagnetic signals that illuminate the main reflector 50. The mid-band feed 40 may also include a conventional microstrip patch array. The array associated with the mid-band feed may include radiating elements positioned as a substrate to the dichroic surface of the subreflector 60. The dichroic surface superstructure permits transmission and reception of energy in the operating frequency band by the elements of the array. Alternatively, a dichroic surface including slots may be required as a separate layer which is transparent to the energy transmitted and received by the mid-band feed 40. Matching of the elements to the fields in the focal region may be used to correct for phase aberrations.

Each element of the array employed with the mid-band feed 40 is fed by a feed network implemented by variable power dividers and phase shifters to provide for conjugate field matching. Each element of the array is also fed by a polarization network, that may be made up of 90-degree hybrids and a variable power divider. The polarization network provides polarization diversity to correct for the cross-polarized component. The variable power dividers and phase shifters may be built into fixed circuits in order to provide a cheaper and simpler system.

All feeds are capable of full duplex (transmit and receive) operation. The type of operation in use in each band may be determined only by the isolation requirement between the appropriate transmitter(s) and the receiver(s), and the relationships and widths of the individual receiver and transmit bands and filtering requirements.

Each feed includes full polarization capability. The emitted signals and received signals may be converted to or from all conventional polarization patterns such as: circular right or left hand, linear in any orientation, and any in between with any ellipticity ratio.

The system includes operating the feeds in combination, with each feed operating simultaneously. For example, both the mid-band feed 40 and high-band feed 30 may operate together. As shown in FIG. 3, the high-band feed 30 is in the path of rays emitted from mid-band feed 40. The high-band feed 30 is primarily reactive to the mid-band signals. The deflective and depolarizing effects on the energy fields emitted and received by the mid-band feed 40, are compensated for by adjusting the excitation of the various elements of mid-band feed 40 phased array. As shown in FIG. 4, the mid-band feed 40 is not in the path of the emissions from the linear feed 30. The mid-band feed 40 and the high-band feed 30 may synthesize independent primary illuminations independently and efficiently by conjugate field matching in order to collimate a plane wave across the main reflector 50.

Because the true focal point of the main reflector 50 is not occupied by either the mid or high band feeds 40,30, each feed includes a system to correct for the aberrations (phase and amplitude) in the E- and H-fields distributed across the space it occupies.

Further by way of example, both the high-band feed 30 and low-band feed 20 may operate together. It is within the scope of the invention that the linear feed 30 extends through the focal point 67. Typically the high-band feed 30 is electrically small because it operates at much smaller wavelengths and, therefore, is not tuned to (but is only reactive to) the low band energy to which it is exposed when in the path of the primary radiation emitted and received by the low band feed 20. Preferably, the high band feed 30 is a distributed feed and, therefore, is not required to occupy the focal point 67 where interference with the low-band feed 20 may be increased and the high band feed 30 may sustain damage at high power operations. As shown in the figures, the high-band feed 30 may be positioned slightly in or out from the focal point 67 to avoid blockage of the low-band feed. As shown in FIG. 4, the low-band feed 20 is not in the path of emissions from the linear feed 30.

Similarly, both the mid-band feed 40 and the low-band feed 20 may operate together. The mid-band feed 40 is a surface feed preferably located adjacent to the surface of the subreflector 60. The dichroic surface of the subreflector is reflective to the radiation in the low-band and transparent to energy in the range of the mid-band feed 40.

As described above, the orientation and arrangement of the antenna feeds reduces mutual blockage. For example, the generally orthogonal relationship between the mid-band feed 40 and the high band feed 30 reduces the blockage between feeds and their respective signals. Similarly, the axial feed 30 presents a narrow profile to the low-band feed 30, thereby reducing blockage.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. An antenna structure comprising:

a parabolic reflector having a focal region;

an ellipsoidal subreflector having real and virtual focal points and a dichroic surface, said subreflector being positioned at the focal region of said parabolic reflector in a Gregorian arrangement;

a phased array antenna feed integral with said subreflector and operating in a mid-frequency band, said phased array antenna feed being capable of illuminating said parabolic reflector and including means for correcting for defocusing aberrations, said dichroic surface being transparent to energy in mid-frequency band;

a linear antenna feed operating in high frequency band, said linear feed capable of illuminating said parabolic reflector, said linear feed being positioned in the illumination path of said phased array feed passing through the real focal point generally along a line connecting the real and virtual focal points, thereby reducing mutual blockage between the illumination from said linear feed and said phased array antenna feed; and a hybrid mode antenna feed operating in a low frequency band, said hybrid mode antenna feed being capable of illuminating said subreflector and being positioned at a point adjacent the virtual focal point of said subreflector.

2. The antenna of claim 1, wherein said linear feed comprises a dielectric polyrod.

3. The antenna of claim 1, wherein said linear feed comprises a Yagi array of crossed dipole elements.

4. The antenna of claim 1, wherein said linear feed comprises a slotted waveguide.

5. The antenna of claim 1, further comprising means for compensating for deflective and depolarizing effects of said linear feed on said hybrid mode feed.

6. The antenna of claim 1, further comprising means for compensating for deflective and depolarizing effects of said linear feed on said phased array feed.

7. An antenna structure comprising:

a primary reflector having a focal region;

an ellipsoidal subreflector having real and virtual focal points and a dichroic surface, said primary reflector and said subreflector being in a Gregorian arrangement;

a first antenna feed positioned adjacent said dichroic surface and being capable of illuminating said primary reflector;

a second antenna feed capable of illuminating said primary reflector and positioned adjacent the real focal point of said subreflector in the path of the illumination of said first antenna feed, said second antenna feed having a major and minor axis, said major axis being substantially parallel to a line connecting the focal points of said subreflector; and a third antenna feed capable of illuminating said subreflector and positioned adjacent the virtual focal point of said subreflector.

8. The antenna of claim 7, wherein said primary reflector is parabolic.

9. The antenna of claim 7, wherein said primary reflector is spherical.

10. The antenna of claim 7, wherein said primary reflector is a ring focus reflector.

11. The antenna of claim 7, wherein said first antenna feed comprises a phased array capable of correcting for defocusing aberrations.

12. The antenna of claim 7, wherein said first antenna feed comprises a patch array.

13. The antenna of claim 7, wherein said second antenna feed comprises an open ended wave guide.

14. The antenna of claim 7, wherein said second antenna feed comprises a dielectric polyrod.

15. The antenna of claim 7, wherein said second antenna feed comprises a linear array including a plurality of radiating elements.

16. The antenna of claim 15, wherein said radiating elements comprise crossed dipoles in a Yagi array.

17. The antenna of claim 15, wherein said radiating elements comprise slots in a waveguide array.

18. The antenna of claim 7, wherein said third antenna feed is a corrugated horn.

19. The antenna of claim 7, wherein said third antenna feed is a scalar horn.

20. The antenna of claim 7, wherein said first antenna feed includes slots on said dichroic surface.

21. The antenna of claim 7, wherein said first antenna feed operates in a mid-frequency band and said second antenna feed operates in a high frequency band.

22. The antenna of claim 18, wherein said third antenna feed operates in a low frequency band.

23. The antenna of claim 7, wherein said dichroic surface of said subreflector reflects signals transmitted and received by said third feed.

24. The antenna of claim 7, wherein said the surface of said subreflector is further shaped to increase illumination efficiency of the main reflector.

25. The antenna of claim 7, further comprising means for adjusting the emissions of said first antenna feed to compensate for deflective and depolarizing effects on said first feed resulting from interference with said second antenna feed.

26. The antenna of claim 7, further comprising means for adjusting said dichroic surface of said subreflector to compensate for deflective and depolarizing effects on said third antenna feed resulting from interference from said second antenna feed.

27. An antenna comprising a main reflector having a focal region, a surface feed and a linear feed in the focal region, said surface feed and said linear feed illuminating said main reflector in different frequency bands, said linear feed being between said main reflector and said surface feed and axially aligned generally along the line between the center of said main reflector and the center of said surface feed to thereby reduce interference between the illuminations from said surface and said linear feed.

28. The antenna of claim 27, further comprising an ellipsoidal subreflector in a Gregorian arrangement with said main reflector, said subreflector having real and virtual focal points.

29. The antenna of claim 28, further comprising a third feed positioned adjacent the virtual focal point, said third feed being capable of illuminating said subreflector and operating in a lower frequency band than said linear and surface feeds.

30. An antenna comprising:

a main reflector having a focal region;

an ellipsoidal subreflector having real and virtual focal points and being positioned in the focal region;

a linear feed capable of illuminating said main reflector from a point adjacent the real focal point of said subreflector, said linear feed being oriented in a direction parallel to a line connecting the focal points of said subreflector; and a hybrid mode feed operating in a lower frequency band than said linear antenna feed capable of illuminating said subreflector from a point adjacent the virtual focal point of said subreflector.

31. The antenna of claim 30, wherein said subreflector comprises a phased array feed capable of illuminating said main reflector.

32. The antenna of claim 31, wherein said subreflector further comprises a dichroic surface transparent to energy omitted and received by said phased array feed.

33. An antenna comprising:

a main reflector having a focal region;

an ellipsoidal subreflector having real and virtual focal points and being positioned in the focal region;

a surface feed adjacent the surface of said subreflector and following the curvature of the surface of said subreflector and being capable of illuminating said main reflector; and a hybrid mode feed operating in a lower frequency band than said surface feed, and being capable of illuminating said subreflector from a point adjacent the virtual focal point of said subreflector.

34. The antenna of claim 33, further comprising a linear feed positioned adjacent the focal point of said subreflector, and being capable of illuminating said main reflector and operating in a higher frequency band than said surface feed and said hybrid mode feed.

35. An antenna including a main reflector and an ellipsoidal sub reflector in a Gregorian arrangement and a main reflector feed for illuminating said main reflector and a subreflector feed for illuminating said subreflector, said main reflector feed being in the illumination path of said subreflector feed, and said reflector and subreflector feeds operating in different frequency bands, said main reflector feed being spaced from but parallel to a line connecting the focal points of said subreflector.

36. An antenna including a main reflector and an ellipsoidal subreflector in a Gregorian arrangement, a reflector feed for illuminating said main reflector in a first frequency band, and a subreflector feed for illuminating said subreflector in a second frequency band, said reflector feed being integral with said subreflector and said subreflector being dichroic to signals in the first frequency band.

37. An antenna including a main reflector and a subreflector in a Gregorian arrangement, a linear feed for illuminating said main reflector in a first frequency band from a point in the focal region of said main reflector and generally aligned along a line connecting the focal points of said subreflector, and a subreflector feed located adjacent the virtual focal point of said subreflector for illuminating said subreflector in a second frequency band, said subreflector including an integral surface feed capable of illuminating said main reflector in a third frequency band.

38. A method of conducting communications between a satellite and an earth based antenna in three frequency bands comprising the steps of:

(a) providing an antenna with a parabolic reflector having a focal region;

(b) positioning an ellipsoidal subreflector at the focal region of the parabolic reflector in a Gregorian arrangement, the subreflector having real and virtual focal points and a dichroic surface;

(c) providing a phased array antenna feed integral with the subreflector, the phased array antenna feed being capable of illuminating the parabolic reflector;

(d) operating the phased array antenna feed in a mid-frequency band to send and receive signals from a satellite;

(e) providing a linear antenna feed positioned in the illumination path of the phased array feed and passing through the real focal point generally along a line connecting the real and virtual focal points and being capable of illuminating the parabolic reflector;

(f) operating the linear antenna feed in a high frequency band to send and receive signals from the satellite;

(g) providing a hybrid mode antenna feed positioned at a point adjacent the virtual focal point of the subreflector and being capable of illuminating the subreflector; and (h) operating the hybrid mode feed in a low frequency band to send and receive signals from the satellite.

39. A method of conducting communications between a satellite and an earth based antenna in three frequency bands comprising the steps of:

(a) sending signals to and receiving signals from a satellite in a mid-frequency band via a parabolic reflector using a phased array antenna feed integral with an ellipsoidal subreflector in a Gregorian arrangement with the parabolic reflector;

(b) sending signals to and receiving signals from a satellite in a high frequency band via the parabolic reflector using a linear antenna feed positioned in the path of rays emitted and received by the phased array feed, the linear feed being positioned along a line passing through the real and virtual focal points of the ellipsoidal subreflector; and (c) sending signals to and receiving signals from a satellite in a low frequency band via the subreflector and the parabolic reflecting using a hybrid mode antenna feed positioned adjacent the virtual focal point of the subreflector.

40. The method of claim 39, further comprising the step of using conjugate field matching to correct for defocusing aberrations in the signal by the phased array feed.

41. The method of claim 39, further comprising the step of using conjugate field matching to correct for defocusing aberrations in the signal by the linear feed.

42. A method for conducting communications between a satellite and a reflector antenna in two frequency bands, the antenna including a parabolic main reflector and an ellipsoidal subreflector in a Gregorian arrangement, comprising the steps of:

illuminating the main reflector in a first frequency band using a linear feed adjacent the real focal point of the subreflector; and illuminating the main reflector in a second frequency band using a surface feed adjacent the surface of the subreflector, the linear feed being substantially orthogonal to a line at the center of the subreflector tangent to the surface thereby reducing the mutual blockage between the antenna feeds.

43. The method of claim 42, further comprising the step of correcting for defocusing aberrations in the signal transmitted by the surface field using conjugate field matching.

44. A method of using a reflector antenna including a main reflector and an ellipsoidal subreflector in a Gregorian arrangement for conducting communications with a satellite comprising the steps of:

transmitting signals to and receiving signals from the main reflector using a phased array antenna feed integral with the subreflector; and transmitting signals to and receiving signals from the main reflector using a horn shaped antenna feed located adjacent the virtual focal point of the subreflector.

45. The method of claim 44, further comprising the step of correcting for defocusing aberrations in the phased array antenna feed using conjugate field matching.

46. An antenna having a main reflector and two feeds illuminating said main reflector from the focal region thereof at different frequencies.

47. An antenna having a main reflector and three feeds illuminating said main reflector in different frequency bands where all three of said feeds are located generally on a line passing through the center of the main reflector and focal point thereof.

* * * * *